US008083203B2

(12) United States Patent
Fournier

(10) Patent No.: US 8,083,203 B2
(45) Date of Patent: Dec. 27, 2011

(54) RETAINING DEVICE FOR ASSEMBLING TWO PANELS, RECYCLABLE FORMWORK FOR FORMING A CONCRETE STRUCTURE AND PACKAGING ASSEMBLY USING THE SAME

(75) Inventor: André Fournier, St-Germain (CA)

(73) Assignee: ABZAC Canada Inc., Drummondville (Quebec) (CA)

( * ) Notice: Subject to any disclaimer, the term of this patent is extended or adjusted under 35 U.S.C. 154(b) by 605 days.

(21) Appl. No.: 12/032,218

(22) Filed: Feb. 15, 2008

(65) Prior Publication Data

US 2008/0197266 A1 Aug. 21, 2008

Related U.S. Application Data

(60) Provisional application No. 60/901,316, filed on Feb. 15, 2007.

(51) Int. Cl.
*B28B 7/00* (2006.01)
*E04G 13/02* (2006.01)

(52) U.S. Cl. ..... 249/48; 249/114.1; 249/159; 249/193; 249/194; 249/219.1

(58) Field of Classification Search ..... 249/48, 249/49, 51, 112–115, 119, 120, 127, 128, 249/131, 132, 134, 139, 155–157, 159, 164, 249/173, 189, 219.1, DIG. 2, 193, 194; 52/745.17–745.18; 264/32, 333
See application file for complete search history.

(56) References Cited

U.S. PATENT DOCUMENTS

| | | | | |
|---|---|---|---|---|
| 1,163,375 A | | 12/1915 | Selfridge | |
| 1,219,272 A | | 3/1917 | Edison | |
| 1,295,310 A | * | 2/1919 | Hartman | 249/49 |
| 2,836,874 A | | 6/1958 | Clarkson | |
| 3,567,173 A | | 3/1971 | Peterson | |
| 3,938,199 A | | 2/1976 | Laven | |

(Continued)

FOREIGN PATENT DOCUMENTS

EP 440587 A1 * 8/1991

(Continued)

OTHER PUBLICATIONS

Translation of EP 0 440 587.*

*Primary Examiner* — Joseph Del Sole
*Assistant Examiner* — Dimple Bodawala
(74) *Attorney, Agent, or Firm* — Fish & Richardson P.C.

(57) ABSTRACT

The invention provides a retaining device for assembling two panels together. The device has a support and first and second pairs of spaced-apart parallel walls extending along the support and projecting outwardly therefrom for providing first and second holding channels extending angularly to each other, each channel being adapted to receive an edge of one of the panels therein in a snugly relationship to allow assembling of the two panels. The invention also provides a formwork for forming a polygonal upright concrete structure using a plurality of retaining devices and a plurality of panels arranged with the retaining devices for providing a forming cavity between the panels adapted to receive concrete therein. There is also provided a packaging assembly for packaging goods using a plurality of retaining devices and a plurality of panels arranged with the retaining devices for providing a protecting cavity between the panels adapted to receive the goods therein.

12 Claims, 6 Drawing Sheets

U.S. PATENT DOCUMENTS 3,951,376 A * 4/1976 Berndt et al. ..... 249/146
3,989,397 A * 11/1976 Baker ..... 403/205
3,990,672 A 11/1976 Buchanan
4,083,526 A 4/1978 Hatfield
4,731,973 A * 3/1988 Stenemann ..... 52/767
4,767,095 A 8/1988 Fitzgerald et al.
4,876,054 A 10/1989 Goodwin et al.
4,957,270 A 9/1990 Rummage et al.
4,976,401 A * 12/1990 Carlson ..... 249/194
4,999,961 A * 3/1991 McNary ..... 52/287.1
5,098,059 A 3/1992 Sawyer
5,169,585 A 12/1992 Le Gourrierec et al.
5,216,863 A 6/1993 Nessa et al.
5,328,142 A 7/1994 Weekers et al.
5,376,316 A 12/1994 Weekers et al.
5,616,271 A * 4/1997 Podgurski ..... 249/48
5,792,552 A 8/1998 Langkamp et al.
5,809,721 A 9/1998 Antropius et al.
5,855,808 A * 1/1999 DiBerardino ..... 249/114.1
6,108,996 A * 8/2000 McGinnis ..... 52/651.02
6,260,816 B1 7/2001 Valero Salinas et al.
6,467,749 B1 10/2002 van de Camp et al.
6,865,859 B2 * 3/2005 Flathau ..... 52/742.14
2002/0179808 A1 12/2002 Salinas
2003/0218265 A1 * 11/2003 Garcia-Gutierrez ..... 264/35
2005/0066592 A1 3/2005 Huber et al.
2005/0229536 A1 10/2005 Yoshii et al.
2005/0247852 A1 11/2005 Valero Salinas
2006/0005497 A1 1/2006 Foell et al.
2006/0016150 A1 1/2006 Fournier
2006/0032172 A1 2/2006 Foell et al.
2008/0289295 A1 * 11/2008 Waters et al. ..... 52/834
2009/0179137 A1 * 7/2009 Fournier et al. ..... 249/48

FOREIGN PATENT DOCUMENTS

FR 2615553 A1 * 11/1988
FR 2684124 A1 * 5/1993
JP 06158857 A * 6/1994
WO WO 9314287 A1 * 7/1993

* cited by examiner

RETAINING DEVICE FOR ASSEMBLING TWO PANELS, RECYCLABLE FORMWORK FOR FORMING A CONCRETE STRUCTURE AND PACKAGING ASSEMBLY USING THE SAME

FIELD OF THE INVENTION

The present invention generally relates to a retaining device for assembling two panels. The invention also relates to formworks for forming concrete structures using such retaining devices and more particularly concerns a formwork for forming a polygonal upright concrete structure that is recyclable and economical to produce and use. The invention also concerns a packaging assembly for packaging goods using such retaining devices, the packaging assembly being also recyclable and economical to produce and use.

BACKGROUND OF THE INVENTION

All liquid concrete that is still uncured needs to be contained, to hold the concrete in place until it hardens sufficiently to hold its own shape. With concrete slabs, the freshly-poured concrete may be retained by existing features such as upright walls, curbs, edgings, etc., or by some form of temporary shuttering also known as a "formwork". The construction of formworks can be quite complicated and expensive, especially on vertical concrete structures such as vertical columns. Indeed, the cost of formworks generally represents a significant proportion of the total cost of the completed concrete structure.

Recently, the use of disposable formworks has been preferred over the use of permanent formworks made of an assembly of wooden or metal stakes, especially when forming vertical concrete structures such as upright columns. After concrete has been cast in a permanent formwork, the wooden or metal stakes cannot be removed before the concrete has at least partially solidified. Unfortunately, the concrete adheres to the stakes of the formwork once it has partially solidified, thus making the stake removal procedure a time-consuming and laborious task.

Many types of disposable formworks have been devised herein to date. For example, disposable formworks made of polystyrene (non-recyclable material) exist, but are plagued with environmental drawbacks. Indeed, when polystyrene formworks are used out in the open on a worksite, wind impinging on the formwork can cause the polystyrene to crumble into granules which eventually become scattered all over the worksite. Moreover, a polystyrene formwork becomes so deteriorated after a single usage that it cannot be used twice. Therefore, pollution occurs each time a polystyrene formwork is used since it must be discarded after a single use but cannot be recycled.

To obviate the environmental drawbacks of using polystyrene, recyclable paperboard has been used in the construction of formworks. Some paperboard formworks generally consist in a paperboard band, made of a plurality of laminated paper plies, wound helicoidally to form a cylindrical tube. The inner wall of the tube is coated with a liner of impervious material (e.g. a plastic sheet) to prevent the moisture of the concrete poured and setting up in the tube to penetrate across the paperboard and cause the delamination of its plies. Other paperboard formworks are structured from a tubular body composed of a number of assembled parts glued together at their interconnecting edges, and a band of reticulated material, e.g. fibreglass mesh, is rolled up helicoidally around the parts of the tubular body ensuring proper mechanical rigidity of the formwork.

For example, U.S. Pat. No. 6,260,816 discloses a discardable formwork for forming columns that relies on the above principles.

The above-described formworks are however still too expensive to produce and time consuming to remove.

In an attempt to improve over the prior art formworks, in US patent application No. 2006/0016150, the Applicant of the present invention provided an improved paperboard formwork that is entirely recyclable and less expensive to produce.

However, it would be still desirable to provide an improved recyclable formwork that would be easier to use and that would even lower the total cost of the completed concrete structure.

Moreover, in the field of packaging, the use of packaging boxes or assemblies specially devised for specific packaging applications has widely spread during the last years. These boxes or assemblies are generally manufactured according to specific dimensions required by a particular application, and can generally not be reused for another application.

It would therefore be desirable to provide a new packaging assembly that would be very easy to produce and use at a low cost while being at least partially reusable.

SUMMARY OF THE INVENTION

An object of the present invention is to provide a retaining device for assembling two panels. The device is provided with an elongated support and a first and a second pair of spaced-apart substantially parallel walls extending along the elongated support and projecting outwardly therefrom for providing first and second holding channels extending angularly to each other. Each channel is adapted to receive an edge of one of the panels therein in a snugly relationship to allow assembling of the two panels.

This retaining device, which is preferably made of plastic, is advantageously used in a variety of applications. For example, an improved recyclable formwork for forming a polygonal upright concrete structure which relies on the use of such retaining devices is provided. As another example, the retaining device of the present invention is also advantageously used for providing an improved packaging assembly.

Another object of the present invention is to provide an improved recyclable formwork that satisfies the above-mentioned needs.

Accordingly, there is provided a formwork for forming a polygonal upright concrete structure comprising a plurality of retaining devices as defined above. The formwork is provided with a plurality of panels arranged successively one relative to the other between two successive retaining devices, each being fitted into the corresponding channels of the adjacent retaining devices so as to provide an inside forming cavity between the panels adapted to receive concrete therein.

In a preferred embodiment, the retaining devices are advantageously made of plastic while the panels are made of paperboard material, preferably honeycomb material, for providing a formwork that is entirely recyclable.

In a further embodiment, the formwork is further provided with a tubular envelope mountable around the panels forming the cavity. The formwork also has a plurality of paper-based reinforcing elements mountable between an inner side of the tubular envelope and outer sides of the panels to provide an enhanced mechanical rigidity to the formwork.

In another preferred embodiment, each of the retaining devices is advantageously further provided with a forming element extending between the channels inside the forming cavity for forming the concrete structure with bevelled edges.

Another object of the present invention is to provide an improved packaging assembly for packaging goods that satisfies the above-mentioned needs.

Accordingly, there is provided a packaging assembly for packaging goods having a plurality of retaining devices as defined above and a plurality of panels arranged successively one relative to the other between two successive retaining devices, each being fitted into the corresponding channel of the adjacent retaining devices so as to provide an inside protecting cavity between the panels adapted to receive the goods therein.

In a preferred embodiment, the retaining devices are advantageously made of plastic while the panels are made of paperboard material for providing a packaging assembly that is entirely recyclable and that can be at least partially reused.

BRIEF DESCRIPTION OF THE DRAWINGS

These and other objects and advantages of the invention will become apparent upon reading the detailed description and upon referring to the drawings in which.

Figure 1A:
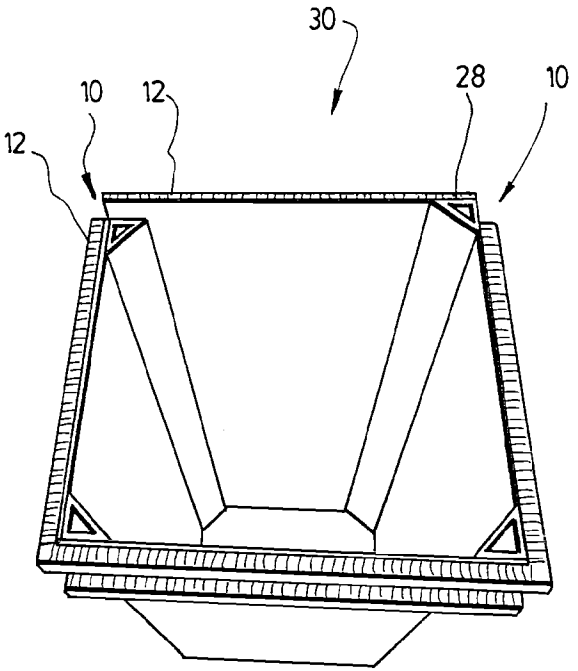
FIG. 1A is an elevated perspective view of a square formwork for forming a square concrete column, according to a preferred embodiment of the present invention.

While the invention will be described in conjunction with example embodiments, it will be understood that it is not intended to limit the scope of the invention to such embodiments. On the contrary, it is intended to cover all alternatives, modifications and equivalents as may be included as defined by the present description and the appended claims.

DESCRIPTION OF PREFERRED EMBODIMENTS

In the following description, similar features in the drawings have been given similar reference numerals and in order to lighten the figures, some elements are not referred to in some figures if they were already identified in a preceding figure.

According to a first aspect, the present invention is concerned with a retaining device for assembling two panels that is very easy to manufacture at a low cost. As it will be more easily understood upon reading of the present description, such retaining devices can advantageously be used in a plurality of specific applications.

More particularly, as it will be detailed thereinafter, according to a second aspect of the present invention, in a first preferred application, such retaining devices are advantageously used for providing a formwork for forming a polygonal upright concrete structure that is advantageously entirely recyclable, more easy to use than those of the prior art and more economical to produce and use.

Moreover, according to a third aspect of the present invention, in a second preferred application, such retaining devices are advantageously used for providing a packaging assembly for packaging goods that is also recyclable and economical to produce and use.

Figure 2:
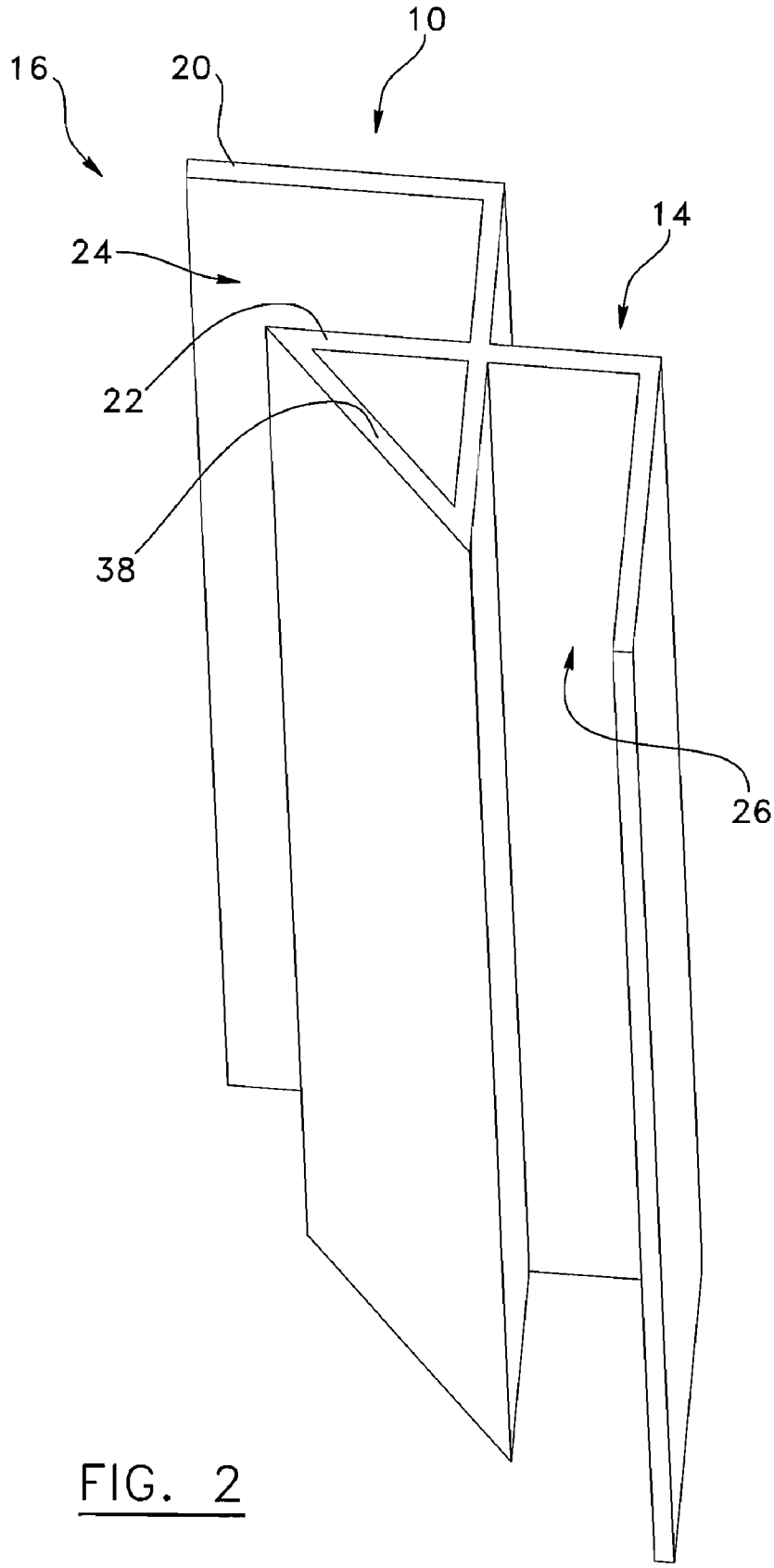
FIG. 2 is a partial elevated perspective view of a retaining device for assembling two panels, according to the present invention.
Figure 3:
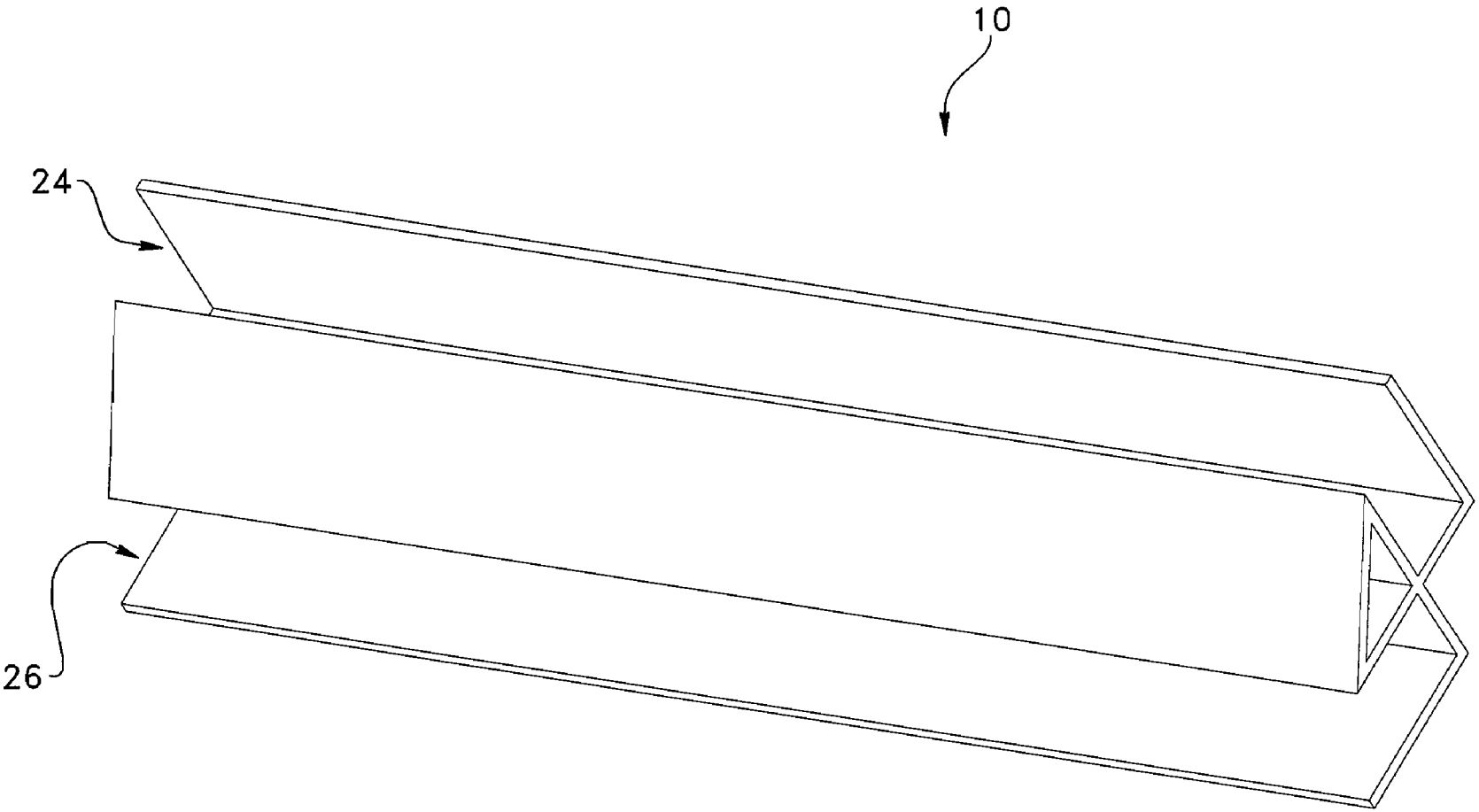
FIG. 3 is another view of the retaining device of FIG. 2.

Referring to FIGS. 2 and 3, there is shown a retaining device 10 for assembling two panels 12 (as better shown in FIG. 5B which will be described in detailed thereinafter), according to the first aspect of the present invention. As illustrated, the retaining device 10 is provided with an elongated support 14 and a first and a second pair 16, 18 of spaced-apart substantially parallel walls 20, 22 extending along the elongated support 14 and projecting outwardly therefrom for providing first and second holding channels 24, 26 extending angularly to each other. Each channel 24, 26 is adapted to receive an edge 28 of one of the panels 12 therein in a snugly relationship to allow assembling of the two panels 12. In a preferred embodiment, the retaining device 10 is made of extruded plastic but other material such as wood as a non-limitative example could also be envisaged.

Figure 4A:
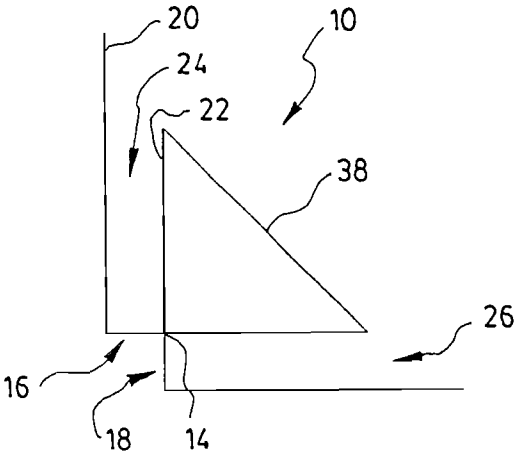
FIGS. 4A to 4F show other preferred embodiments of the retaining device, according to the present invention.
Figure 4B:
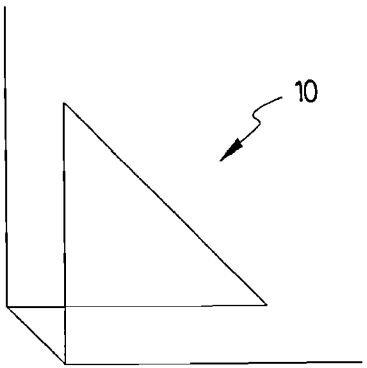
Figure 4C:
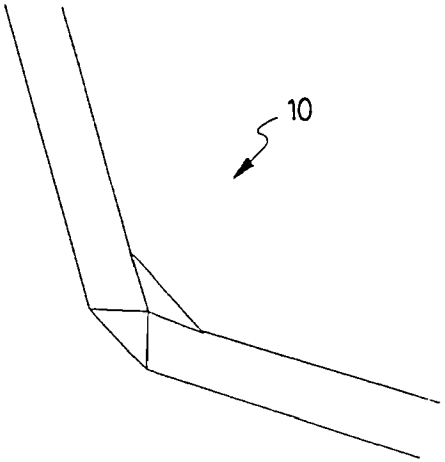
Figure 4D:
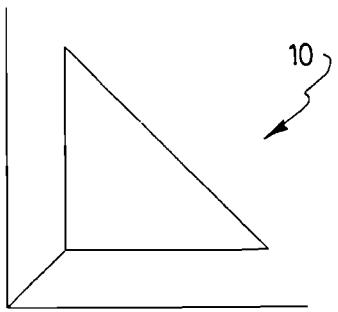

In the embodiment illustrated in FIGS. 2, 3, 4A, 4B and 4D to 4F, each of the first and second holding channels 24, 26 extends at substantially 90 degrees to each other, the elongated support 14 being shaped for providing a back wall to each channel 24, 26. This embodiment advantageously allows to mount the two panels 12 at 90 degrees to each other. Of course, the channels 24, 26 can extend at any specific angle required by a particular application. For example, in the embodiment shown in FIG. 4C, the channels 24, 26 form an obtuse angle therebetween. It should also be noted that the channels 24, 26 can extend at substantially 180 degrees to each other on each side of the elongated support 14, as it will be more clearly detailed thereinafter.

Figure 1B:
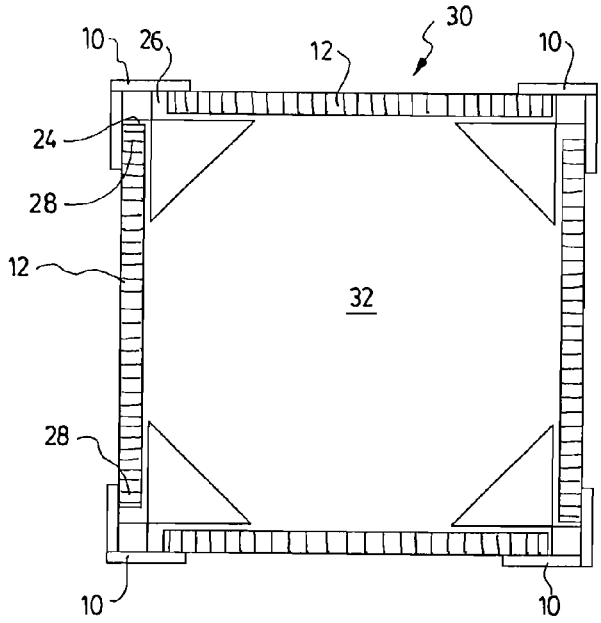
FIG. 1B is a top view representation of the square formwork of FIG. 1A.

Referring now to FIGS. 1A and 1B, there is shown a formwork 30 for forming a polygonal upright concrete structure (not shown) according to the second aspect of the present invention and according to a preferred embodiment thereof. The illustrated formwork is a square formwork 30 devised to form a square upright concrete structure. The formwork 30 is provided with four retaining devices 10 as described above and as shown in FIGS. 2 and 3. In the illustrated case, the channels 24, 26 extend at 90 degrees to each other. The formwork 30 also has four panels 12 arranged successively one relative to the other between two successive retaining devices 10. As better shown in FIG. 1B, each panel 12 has two opposed edges 28, each being fitted into the corresponding channel 24, 26 of the adjacent retaining device 10 so as to provide an inside forming cavity 32 between the panels 12 adapted to receive concrete therein. Of course, it should be understood that any polygonal shape of the inside forming cavity 32 can be done for a specific application. In this case, the angle between the channels 24, 26 of each retaining device 10 can be chosen according to the specific application. The number of the panels 12 has also to be chosen accordingly.

Preferably, as shown in FIGS. 1A and 1B, the panels 12 are advantageously made of paper-based material, more preferably honeycomb material, in order to provide a greater rigidity to the formwork 30. The use of a plurality of corrugated paperboard sheets stacked together can also advantageously be used to provide the convenient mechanical rigidity to the formwork. As better shown in FIG. 5B which shows another preferred embodiment that will be further described thereinafter, the first and second pairs 16, 18 of parallel walls 20, 22 defining the first and second holding channels 24, 26 are preferably particularly shaped so that the distance between the walls 20, 22 substantially corresponds to the thickness of the panels 12. Thus, the edges 28 of the panels 12 advantageously snugly fit in the channels 24, 26, which are then able to retain the panels 12 therein, even when mechanical stress is applied on the panels from the inside forming cavity 32. In the preferred embodiment, it is contemplated that the panels 12 be removably fitted into the channels 24, 26 of the retaining devices 10. However, other arrangements could be considered. Moreover, it should also be mentioned that the width of each wall 20, 22 of each pair of walls 16, 18 or, in other words, the depth of each channel 24, 26 could also be chosen according to a specific application.

Figure 5A:
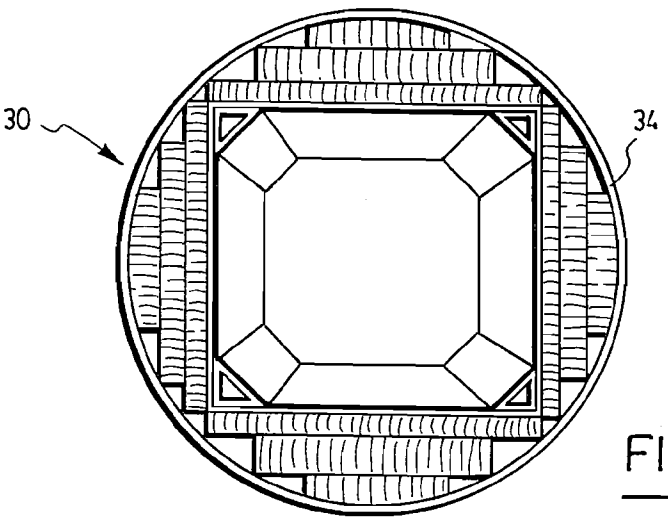
FIG. 5A is a top view of another formwork, according to another preferred embodiment of the present invention.
Figure 5B:
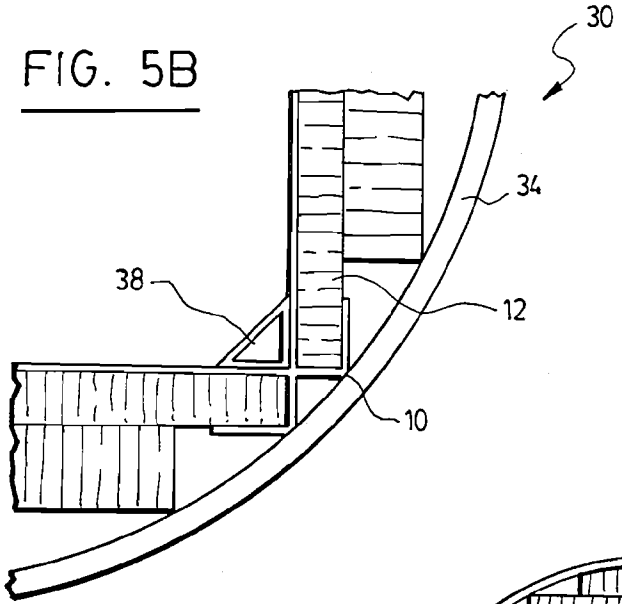
FIG. 5B is a partial enlarged view of the formwork of FIG. 5A.
Figure 5C:
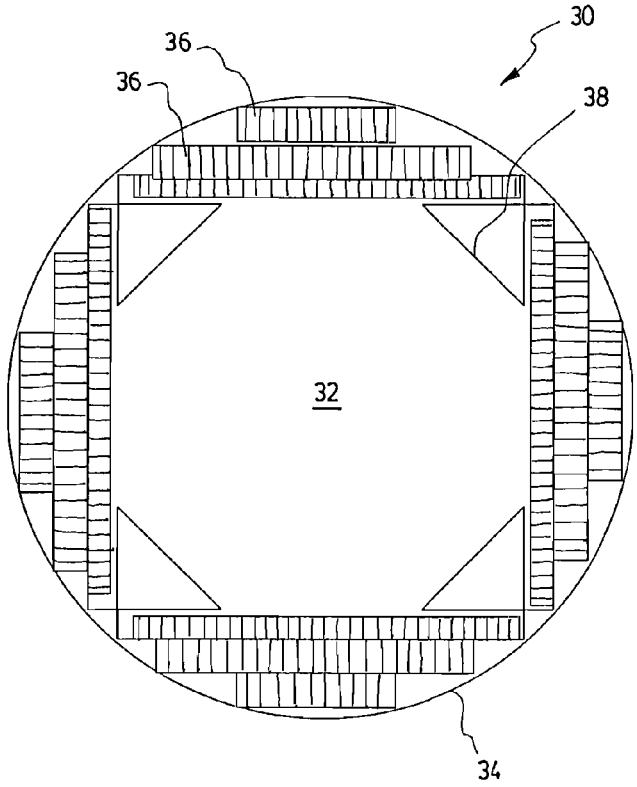
FIG. 5C is a top view representation of the formwork of FIG. 5A.

Referring now to FIGS. 5A to 5C, which show another preferred embodiment of the formwork of the present invention, when improved mechanical rigidity of the formwork 30 is required, the formwork can advantageously be nested inside a tubular envelope 34, preferably a paperboard tubular envelope. In the illustrated embodiment, the formwork 30 is square shaped and the tubular envelope 34 has a cylindrical elongated shape but it should be understood that any other shape could be envisaged for a particular application and is believed to be within the scope of the present invention. As better illustrated in FIG. 5C, in this preferred embodiment, the formwork 30 is also provided with a plurality of paper-based reinforcing elements 36 mountable between an inner side of the tubular envelope 34 and the outer sides of the panels 12. Preferably, the reinforcing elements 36 are made of a plurality of honeycomb or corrugated paperboard sheets stacked together. This preferred embodiment can advantageously withstand higher amounts of mechanical stress.

Indeed, when liquid-form concrete is poured inside the forming cavity of a formwork, the liquid concrete applies substantial pressure on the peripheral surface of the forming cavity. This pressure is of course most important at the base of the formwork, as is the case with any liquid-filled container.

Some prior art disposable formworks include a number of wall elements disposed and glued edge to edge. With such prior art formworks, the load arising from concrete-applied pressure is concentrated at the glue joint located between interconnecting edges of the wall elements. This glue joint being generally unable by itself to hold the wall elements together against the weight bias of the freshly-poured concrete, a band of reticulated material, e.g. fibreglass mesh, needs to be added and generally rolled up helicoidally around the wall elements to ensure mechanical rigidity of the formwork. The fibreglass mesh portions overlapping interconnected wall element edges, when liquid-form concrete is poured in the formwork, are nevertheless subjected to very important tensile loads, especially in the base region of the formwork.

Advantageously, with the above described preferred embodiment, contrary to what is proposed in the prior art, the formwork can adequately resist to the load of freshly-poured concrete, without recourse to glue or bands of reticulated material to hold the wall elements together, thus keeping production costs to a minimum.

Of course, as previously mentioned, a person well versed in the art would easily understand that the formwork 30 of the present invention is particularly well suited for forming a concrete structure of any polygonal shape. In other words, the shape and number of panels 12 could be modified to obtain different shapes of concrete columns. For example, the formwork 30 could comprise six panels 12 of identical dimensions (instead of four as shown in FIG. 5A), arranged edge-to-edge with six retaining devices 10 to form a cross-sectionally hexagonal forming cavity, for forming concrete columns of hexagonal cross-sections. With the present formwork, it is therefore advantageously possible to form columns of different shapes by modifying only the arrangement of the panels.

Figure 4E:
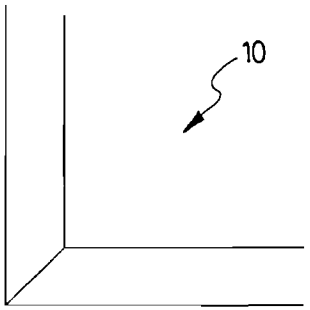
Figure 4F:
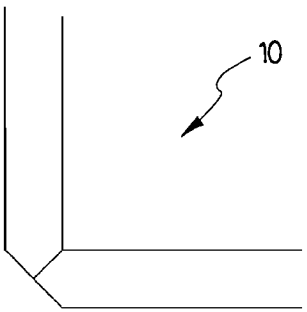

Referring again to FIGS. 1A to 3 and also to FIG. 5B, each of the retaining devices 10 of the formwork 30 can advantageously be provided with a forming element 38 extending between the channels 24, 26 inside the forming cavity 32 for forming the concrete structure with bevelled edges at the corners thereof. In the illustrated case, the retaining device 10 is advantageously an extruded plastic device having the forming element 38 extending between the two channels 24, 26, in the corner thereof and therealong. In the illustrated case, the support 14, the channels 24, 26 and the forming element 38 of each retaining device 10 are integral to each others and the forming element 38 has a planar shape. A person well versed in the art would easily understand that this forming element 38 can have any convenient shape required by a particular application. For example, the forming element 38 could have the shape of an arc. This would allow to form, for example, a square concrete column with rounded edges. The retaining devices 10 shown in FIGS. 4A to 4D are provided with a forming element 38 for forming shaped bevels at the corners of the concrete structure while those shown in FIGS. 4E to 4F are not provided with such forming element 38.

As described above, the formwork of the present invention is particularly useful for forming polygonal structure but can also be of interest for forming structures having other shapes. For example an oval column could be formed. In this particular case which is not illustrated, the formwork is provided with four retaining devices 10, each holding channel 24, 26 of each retaining device 10 extending at substantially 180 degrees to each other on each side of the elongated support 14. The formwork has first and second panels 12 having a flat shape and third and fourth panels 12 having a semi-circular shape. The panels 12 are arranged in an alternated manner for providing the forming cavity with an oval shape. In this embodiment, a person well versed in the art will understand that the use of a tubular envelope and a plurality of reinforcing elements mounted around the forming cavity is preferable.

In the embodiment just described above, each wall 20, 22 of a pair of wall 16, 18 is parallel and contiguous to a corresponding wall of the other pair of walls. Thus the column formed in the forming cavity has a substantially perfect oval shape. However, a forming element 38 can be added on the walls inside the forming cavity to form a column having an ornamental design.

Referring again to FIGS. 1A and 1B, as well known in the art, the inner sides of the panels 12 are advantageously provided with an impervious liner, such as a plastic sheet, applied thereto for providing an impervious barrier between the forming cavity 32 and the inner sides of the panels 12. This prevents water escaping from the moist freshly-poured concrete from penetrating into the paperboard material of the panels 24. This also advantageously greatly facilitates the form removal procedure.

Figure 6A:
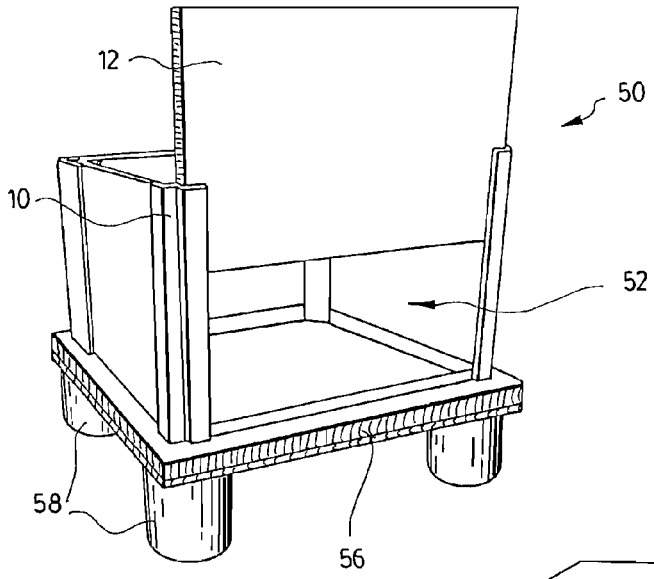
FIG. 6A is a perspective view of a packaging assembly according to a preferred embodiment of the present invention, the packaging assembly being partially mounted.
Figure 6B:
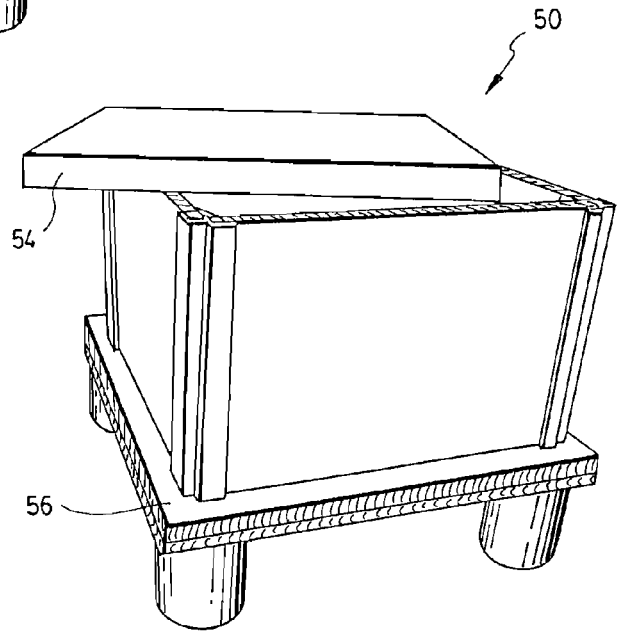
FIG. 6B is another perspective view of the packaging assembly of FIG. 6A, the assembly being provided with a bottom lid and an upper lid.
Figure 6C:
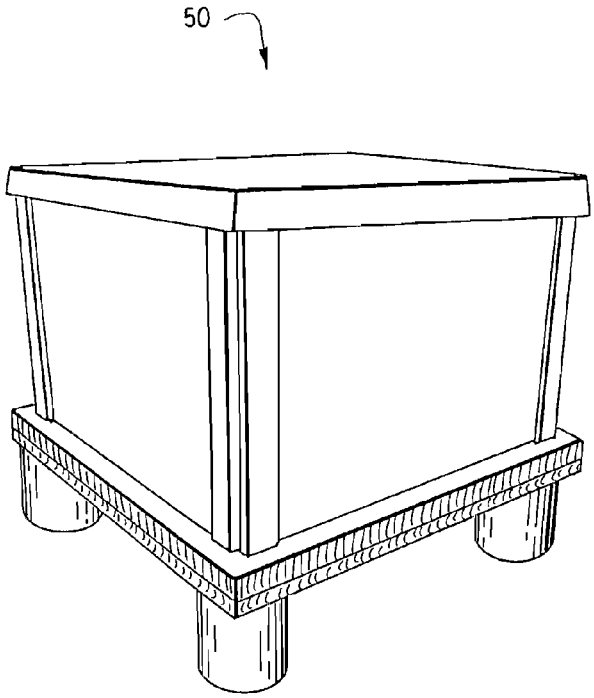
FIG. 6C is another perspective of the packaging assembly of FIG. 6B, the assembly being in a mounted position.

As previously mentioned, according to the third aspect of the present invention, there is also provided a packaging assembly for packaging goods. As shown in FIGS. 6A to 6C, the packaging assembly 50 is provided with a plurality of retaining devices 10 as described above and as shown in FIGS. 2, 3, 4A, 4B and 4D to 4F. The packaging assembly 50 also has a plurality of panels 12 arranged successively one relative to the other between two successive retaining devices 10, each being fitted into the corresponding channel 24, 26 of the adjacent retaining devices 10 so as to provide an inside protecting cavity 52 between the panels 12 adapted to receive the goods therein. In the illustrated embodiment, the packaging assembly 50 has four panels 12 and four retaining devices 10 for providing a rectangular assembly, even if other arrangements could also be envisaged. As illustrated in FIG. 6A, the panels 12 are advantageously removably fitted into the channels 24, 26 of the retaining devices 10. This is particularly advantageous since it render the assembly modular. Thus, some parts can be easily replaced while some other can be reused. Moreover, it also allows to easily dismount the assembly. Thus, the packaging assembly, once dismounted, can be stored in a reduced space.

In the illustrated embodiment, the panels 12 are made of paper-based material, preferably honeycomb paperboard or a plurality of corrugated paperboard sheets stacked together, and the retaining devices 10 are made of extruded plastic to provide a packaging assembly 50 that is entirely recyclable. The packaging assembly 50 can advantageously be provided with an upper lid 54 and a bottom lid 56 mountable with the protecting cavity 52 for defining a closed protecting cavity. The packaging assembly 50 can also be provided with supporting elements or legs 58 that are particularly mounted so that the packaging assembly 50 can be manipulated like a pallet.

A person well versed in the art to which the invention pertains will easily understand that the proposed packaging assembly 50 is particularly advantageous over those of the prior art: it is heavy duty, economical, very easy to mount and dismount, stackable, reusable and recyclable, while allowing to reduce the costs associated with the manipulation and transport.

Although preferred embodiments of the present invention have been described in detail herein and illustrated in the accompanying drawings, it is to be understood that the invention is not limited to these precise embodiments and that various changes and modifications may be effected therein without departing from the scope of the present invention.

What is claimed is:

1. A recyclable formwork for forming an upright concrete structure, said formwork comprising:

a plurality of retaining devices, each device comprising:

an elongated support;

a first and second pair of spaced-apart substantially parallel walls extending along the elongated support and projecting outwardly therefrom for providing first and second holding channels extending angularly to each other, each channel being adapted to receive an edge of a panel therein in a snugly relationship; and a plurality of panels arranged successively one relative to the other between two successive retaining devices, each panel being fitted into the corresponding channels of the adjacent retaining devices so as to provide an inside forming cavity between the panels adapted to receive concrete therein;

a tubular envelope mountable around the panels forming the cavity; and a plurality of reinforcing paperboard sheets stacked between an inner side of the tubular envelope and outer sides of the panels to provide an enhanced mechanical rigidity to the formwork;

the retaining devices, the panels, the tubular envelope and the reinforcing elements being made of a recyclable material.

2. The recyclable formwork according to claim 1, wherein the tubular envelope has a cylindrical elongated shape.

3. The recyclable formwork according to claim 1, wherein each of said retaining devices is further provided with a forming element extending between the channels inside the forming cavity for forming said concrete structure with bevelled edges.

4. The recyclable formwork according to claim 1, wherein said retaining devices are made of extruded plastic and said panels are made of a recyclable paperboard material.

5. The recyclable formwork according to claim 1, wherein each of said panels is provided with an inner impervious liner.

6. The recyclable formwork according to claim 3, wherein the support, the channels and the forming element of each retaining device are integral to each other.

7. The recyclable formwork according to claim 1, wherein the formwork comprises four retaining devices, each holding channel of each retaining device extending at substantially 90 degrees to each other, the plurality of panels comprising four panels having a flat shape for providing said forming cavity with a rectangular shape.

8. The recyclable formwork according to claim 1, wherein the formwork comprises four retaining devices, each holding channel of each retaining device extending at substantially 180 degrees to each other on each side of the elongated support, the plurality of panels comprising first and second panels having a flat shape and third and fourth panels having a semi-circular shape, said panels being arranged in an alternated manner for providing said forming cavity with an oval shape.

9. The recyclable formwork according to claim 1, wherein the panels are removably fitted into the channels of the retaining devices.

10. The formwork according to claim 1, wherein each of said panels is made of paper-based material.

11. The formwork according to claim 10, wherein said paper-based material comprises honeycomb paperboard.

12. The recyclable formwork according to claim 10, wherein said paper-based material comprises a plurality of corrugated paperboard sheets stacked together.

* * * * *